US008006524B2

(12) United States Patent
Lopez et al.

(10) Patent No.: US 8,006,524 B2
(45) Date of Patent: Aug. 30, 2011

(54) OPTICAL DISK SECURITY DEVICE HAVING A MAGNETICALLY ACTUABLE LOCKING MECHANISM

(75) Inventors: Pedro Lopez, Pompano Beach, FL (US); Dennis L. Hogan, Boca Raton, FL (US); Paul Griffiths, legal representative, Boynton Beach, FL (US); Franklin H. Valade, Jr., Fort Walton Beach, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 688 days.

(21) Appl. No.: 11/792,647

(22) PCT Filed: Dec. 7, 2005

(86) PCT No.: PCT/US2005/044689

§ 371 (c)(1),
(2), (4) Date: May 13, 2008

(87) PCT Pub. No.: WO2006/063263

PCT Pub. Date: Jun. 15, 2006

(65) Prior Publication Data

US 2009/0151404 A1 Jun. 18, 2009

Related U.S. Application Data

(60) Provisional application No. 60/683,657, filed on May 23, 2005, provisional application No. 60/633,813, filed on Dec. 7, 2004.

(51) Int. Cl.
*E05B 73/00* (2006.01)

(52) U.S. Cl. ..... 70/57.1; 70/63; 70/276; 206/1.5; 206/308.2; 206/387.11; 292/251.5

(58) Field of Classification Search ..... 70/57.1, 70/63, 276; 206/1.5, 308.2, 387.11; 292/251.5
See application file for complete search history.

(56) References Cited

U.S. PATENT DOCUMENTS

| | | | | |
|---|---|---|---|---|
| 4,457,240 | A * | 7/1984 | Hungerford | 109/45 |
| 6,082,156 | A * | 7/2000 | Bin | 70/57.1 |
| 6,543,261 | B2 * | 4/2003 | Kolton et al. | 70/57.1 |
| 6,631,629 | B1 * | 10/2003 | Fuss et al. | 70/57.1 |
| 6,662,950 | B1 * | 12/2003 | Cleaver | 206/710 |
| 6,832,498 | B2 * | 12/2004 | Belden et al. | 70/57.1 |
| 6,931,895 | B1 * | 8/2005 | Ahn | 70/57.1 |
| 7,260,962 | B2 * | 8/2007 | Lax et al. | 70/57.1 |
| 2007/0295039 | A1 * | 12/2007 | Belden | 70/57.1 |

* cited by examiner

*Primary Examiner* — Lloyd Gall
(74) *Attorney, Agent, or Firm* — Alan M. Weisberg; Christopher & Weisberg, P.A.

(57) ABSTRACT

Systems and apparatuses for a magnetically actuable locking mechanism and a security device having a magnetically actuable locking mechanism are disclosed.

26 Claims, 11 Drawing Sheets

DETAIL A

OPTICAL DISK SECURITY DEVICE HAVING A MAGNETICALLY ACTUABLE LOCKING MECHANISM

This application claims priority to the U.S. Provisional Patent Application Ser. No. 60/633,813 titled "Improved EAS Security Tags" filed Dec. 7, 2004, and to the U.S. Provisional Patent Application Ser. No. 60/683,657 titled "Improved EAS Security Tags" filed May 23, 2005, both of which are incorporated herein by reference in their entirety.

RELATED APPLICATIONS

This international application designating the United States of America is related to the following applications designating the United States of America:

(1) "Magnetically Actuable Locking Mechanism and Associated Security Device", U.S. patent application Ser. No. 11/792,633;

(2) "Security Device for an Article Having a Constrained Elongate Element", U.S. patent application Ser. No. 11/792,631;

(3) "Security Device Having a Cable", U.S. patent application Ser. No. 11/792,623; and (4) "Security Device for a Bottle", U.S. patent application Ser. No. 11/792,632.

These related applications are being filed concurrently herewith and are incorporated by reference in their entirety.

BACKGROUND

A security tag system is designed to prevent unauthorized removal of an item from a controlled area. For example, a typical Electronic Article Surveillance (EAS) system may comprise a monitoring system and one or more security tags. The monitoring system may create a surveillance zone at an access point for the controlled area. A security tag may be enclosed in a security device that is secured to the monitored item, such as an optical disc (OD), such as any type of Compact Disc (CD), including, for example, a Compact Disc Read Only Memory (CD-ROM), Mini CD-ROM, Compact Disc Recordable (CD-R), and Compact Disc Rewritable (CD-RW); any type of Digital Video Disc or Digital Versatile Disc (DVD), including, for example, a DVD, DVD Read Only Memory (DVD-ROM), DVD Recordable (DVD-R), High Definition DVD (HD-DVD); and a Blu-ray disc (BD); and other items, such as eyeglasses, wine and other bottles, and jewelry, for example. If the monitored item enters the surveillance zone, an alarm may be triggered to indicate unauthorized removal.

The security device may be secured to a number of different items. It may be desirable for the security device to allow authorized release from the article, while making unauthorized release relatively difficult. Consequently, there may be a need for improved techniques in security devices in general, and systems for securing the security devices to articles in particular.

BRIEF DESCRIPTION OF THE DRAWINGS

The subject matter regarded as embodiments is particularly pointed out and distinctly claimed in the concluding portion of the specification. Embodiments, however, both as to organization and method of operation, may best be understood by reference to the following detailed description when read with the accompanying drawings in which:

DETAILED DESCRIPTION

Embodiments may be directed to apparatuses, systems and methods for pairing an article, such as an OD, or other object, with a security tag. For example, one embodiment may include a security device comprising a locking mechanism, security tag, and a housing. The locking mechanism may comprise a magnetically actuable latch, a flexible element that biases the magnetically actuable latch toward a locking position, and a latch mating element that mates with at least a portion of the magnetically actuable latch in the locking position. As used herein, the "locking position" may refer to the position of the magnetically actuable latch in which it is partially or fully within a void of, in engagement with, joined with, or otherwise mated with the latch mating element. The housing may be a structure configured to partially or fully contain, enclose, or otherwise secure the locking mechanism, security tag, latch mating element, and the article to the housing. The housing may be configured to secure a CD or other optical disc, and may include a bottom housing, a locking mechanism cover, security tag cover, bottom cover, and top cover. As secured, the magnetically actuable latch of the locking mechanism may mate with the latch mating element in the locking position to lock the housing, and thus the security tag with which the housing is secured, to the article. When the housing is locked, the security device may prevent or provide resistance to an attempt to separate the housing from the article. Another embodiment may include a security system comprising the security device and a detacher, which may be a device that includes a magnet. The detacher may be employed to unlock the housing by magnetically forcing the magnetically actuable latch away from the locking position.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Numerous specific details may be set forth herein to provide a thorough understanding of the embodiments. It will be understood by those skilled in the art, however, that the embodiments may be practiced without these specific details. In other instances, well-known methods, procedures and components have not been described in detail so as not to obscure the embodiments. It can be appreciated that the specific structural and functional details disclosed herein may be representative and do not necessarily limit the scope of the embodiments.

Figure 1:
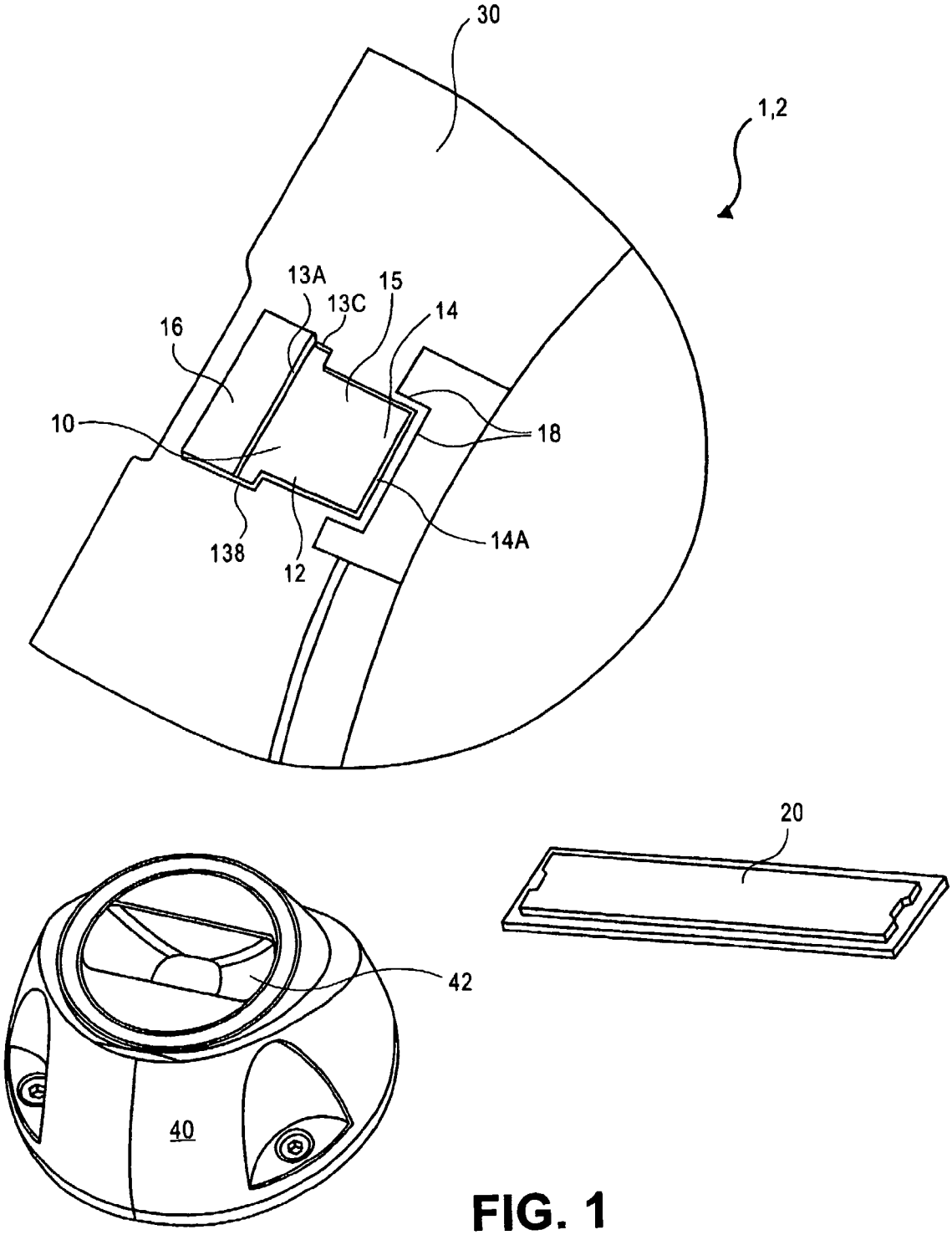
FIG. 1 illustrates components of a security device and system, in accordance with one embodiment.
Figure 1A:
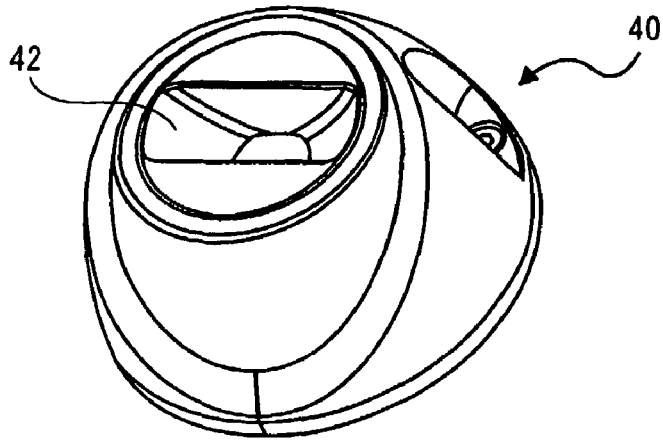
FIG. 1A illustrates a perspective view of a detacher, in accordance with one embodiment.
Figure 1B:
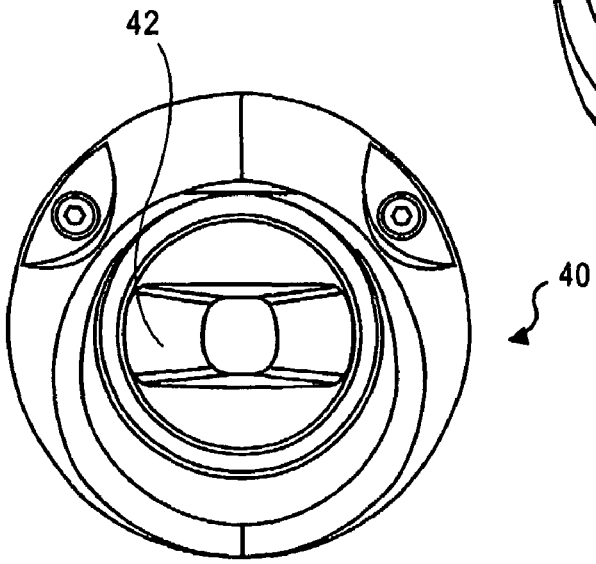
FIG. 1B illustrates a top view of a detacher, in accordance with one embodiment.
Figure 1C:
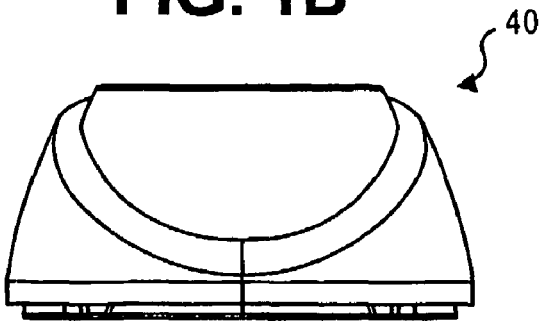
FIG. 1C illustrates a front view of a detacher, in accordance with one embodiment.
Figure 1D:
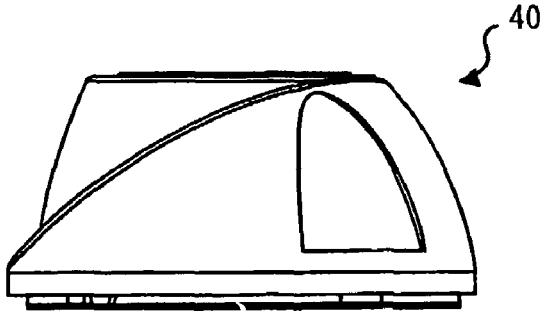
FIG. 1D illustrates a side view of a detacher, in accordance with one embodiment.

Referring now in detail to the drawings wherein like parts are designated by like reference numerals throughout, there is illustrated in FIG. 1 a front view of components that may be included in a security system 1 and a security device 2 in accordance with one embodiment. In this embodiment, the security system 1 includes the security device 2 and a detacher 40. The security device 2 may include a locking mechanism 10, security tag 20, and housing 30.

The locking mechanism 10 may be a magnetically actuable locking mechanism, and may include a magnetically actuable latch 12, flexible element 16, and latch mating element 18.

The magnetically actuable latch 12 may include a base portion 13, which may include a base portion end 13A and base portion side surfaces 13B and 13C; and a latching portion 14, which may include a latching portion end 14A; and a central portion 15.

The magnetically actuable latch 12 defines opposed major surfaces substantially parallel to a recessed surface of an OD receptacle and may have a substantially rectangular-shaped face such that the base portion 13 has the same width as both the latching portion 14 and central portion 15. Thus, the width of the base portion 13, or the distance between the side surfaces 13B and 13C, may be the same as the corresponding widths of the latching portion 14 and central portion 15. In other embodiments, the widths of the base portion 13, latching portion 14, and central portion 15 may differ. The magnetically actuable latch 12 may have a slender, uniform cross-section.

However, the magnetically actuable latch 12 may be configured as desired, may comprise one or more pieces, and may be symmetrical or unsymmetrical about any point, line, or plane. For example, in various embodiments the magnetically actuable latch 12 may be configured with a "T", "I", curved, or other shape of face and with a rectangular, circular, thick, hollow or otherwise voided, and/or non-uniform cross-section, or as described herein with respect to embodiments of the magnetically actuable latch 112. In another embodiment, the latching portion end 14A of the magnetically actuable latch 12 may include one or more teeth, ribs, notches, jags, points, curves, voids, or other shapes such as those described herein with respect to embodiments of the magnetically actuable latch 112, while the base portion end 13A may be flat or another shape. In addition, the base portion end 13A may be continuous or discontinuous. The magnetically actuable latch 12 may be configured such that at least a portion of it, such as the latching portion 14, may engage, receive, insert into, or otherwise mate with the latch mating element 18, such as described herein.

In one embodiment, a security device 2 includes multiple magnetically actuable latches 12, which may be disposed, possibly each along with another flexible element 16 and latch mating element 18, in the same or different portions of the security device 2. For example, in one embodiment, the multiple magnetically actuable latches 12 may each cooperate with another portion of the security device 2 to lock the portion, such as, for example, a portion securing an article or a portion securing a security tag 20.

The magnetically actuable latch 12 may comprise or be formed of a magnetic material such as iron, nickel, or cobalt, or an alloy of iron, nickel, or cobalt. In one embodiment, the magnetically actuable latch 12 includes one or more magnetic materials and may also include one or more nonmagnetic materials.

The flexible element 16 may be shaped as desired, such as in a cuboid, ellipsoid, coil, or any other shape such as described herein with respect to the embodiments of the flexible element 116, and may include one or more pieces, or may be combined or integrally formed with the magnetically actuable latch 12. In one embodiment, the flexible element 16 may be shaped as a cantilever arm, such as, for example, a leaf spring. The flexible element 16 may comprise or be formed of a flexible material such as a light, porous, semirigid, elastic, gaseous, and/or spongy material that may provide a resistant force when compressed and may partially or fully recover its uncompressed shape when the compressive force is removed. For example, in various embodiments, the flexible element 16 may comprise or be formed of a foam rubber, polymeric foam, ceramic foam, or other foam; a rubber; and/or another material or materials. The flexible element 16 may also or alternatively be configured to provide the resistant force when compressed. For example, in various embodiments the flexible element 16 may be configured as a coil, leaf or other cantilevered arm, or other spring, or other like member, that comprises a metal, polymer, ceramic, and/or another material or materials. The flexible element 16 may have any of various masses.

The latch mating element 18 may be configured as desired, such as with one or more holes or other voids, ribs, teeth, protrusions, or other shapes. The latch mating element 18 may include one or more pieces, and may be separate from or integral with the housing 30, such as described herein. The latch mating element 18 may be configured to engage, receive, insert into, or otherwise mate with at least a portion of the magnetically actuable latch 12. For example, in an embodiment where the magnetically actuable latch 12 is a slender member with a rectangular shape of face, the latch mating element 18 may be configured with a void in which the latching portion 14 of the magnetically actuable latch 12 or a part thereof may be inserted into the locking position, as described herein. In an embodiment where the magnetically actuable latch 12 is toothed at its latching portion end 14A, the latch mating element 18 may be configured with ribs that engage the teeth in the locking position.

The security tag 20 may be any detectable device or system, such as any security tag or label. For example, in various embodiments the security tag 20 may be any type of EAS tag (e.g., Radio Frequency (RF) tag, acousto-magnetic tag, and/or combinations thereof), Radio Frequency Identification (RFID) tag, smart tag, or other detectable anti-theft or other tag. The security tag 20 may be detectable by a corresponding detecting system or device, such as, depending on the type of security tag or label, an acoustomagnetic detector, electromagnetic detector, radio frequency detector, or other detector.

The housing 30, as partially shown in the embodiment of FIG. 1, may be any casing or other structure that partially or fully contains and/or surrounds, encloses, affixes to, interlocks with, or otherwise secures the locking mechanism 10 and security tag 20, and, when the locking mechanism 10 is in the locking position and the housing is thereby locked, an article. The housing 30 and locking mechanism 10 may thus cooperate to secure, or lock, the article to the housing 30, and thus the security device 2. The housing 30 may be configured as desired, and may be shaped based upon the shapes of the locking mechanism 10, security tag 20, and article for which it is designed to secure, such as described herein with respect to the embodiments of the housing 130. The housing 30 may include the latch mating element 18, which may be integral with the housing 30. The housing 30 may alternatively be configured to pair with the latch mating element 18. The housing 30 may comprise a polymer and/or another material or materials.

The components included in the security device 2 may be configured such that the security device 2 may lock to an article, such as described with respect to the security device embodiments below. The security tag 2 may be reusable or may be for one-time use.

FIGS. 1A-1D illustrate a perspective, top, front, and side view of the detacher 40 shown in FIG. 1, in accordance with one embodiment. The detacher 40 may be a device that includes and houses a magnet 42. The magnet 42 may be any type of magnet, such as any permanent magnet or electromagnet, for example. Regarding the security system 1, the detacher 40 may be employed with the security device 2 to unlock the security device 2 from an article. The detacher 40 may be positioned appropriately near the magnetically actuable latch 12 of the security device 2 to magnetically force the magnetically actuable latch 12 away from the locking position, thus allowing the housing 30 of the security device 2 to be removed from an article to which it may be locked.

In various embodiments, the detacher 40 may include different magnets 42. For example, the magnet 42 of the detacher 40 may be selected based upon the magnetic force needed to move the magnetically actuable latch 12 away from the locking position, thus unlocking the security device 2. This magnetic force may need to more than offset the forces opposing the movement. Such opposing forces may include, for example, the resistant force provided by the flexible element 16 when it is compressed by the magnetically actuable latch 12, frictional forces caused by the magnetically actuable latch 12 contacting the housing 30 and/or another element during movement, and other forces. In another embodiment, where a detacher 40 is intended to be used on various security devices having different configurations, a magnet 42 may be selected that is strong enough to unlock the security device requiring the strongest magnet to unlock it.

Figure 1E:
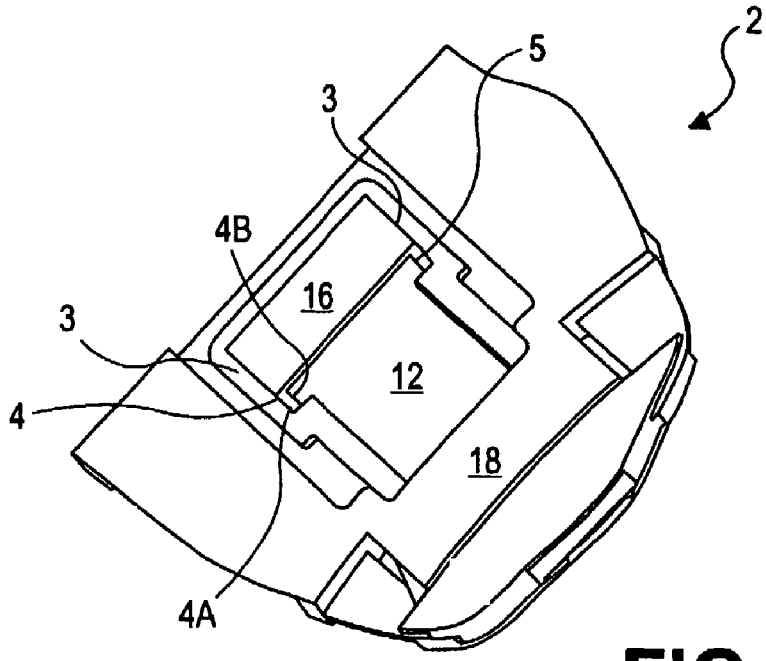
FIG. 1E illustrates a perspective view of a portion of a security device configured for one-time use.
Figure 1F:
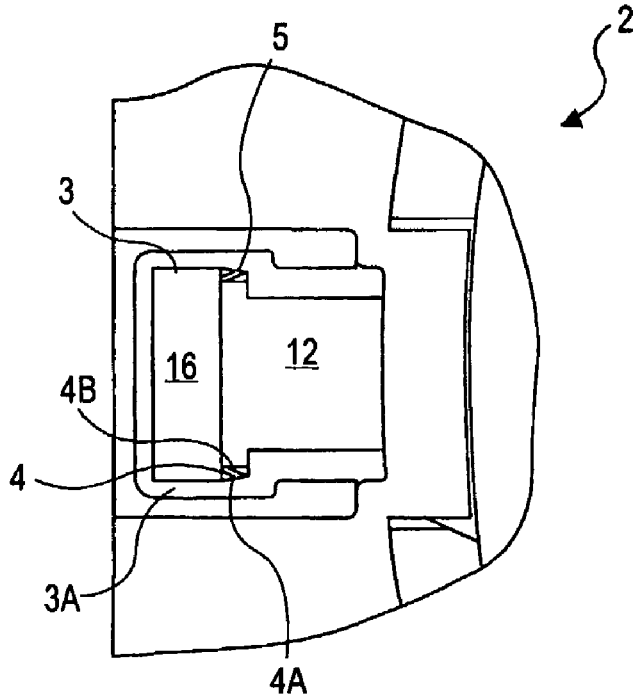
FIG. 1F illustrates a top view of portion of a security device configured for one-time use.
Figure 1G:
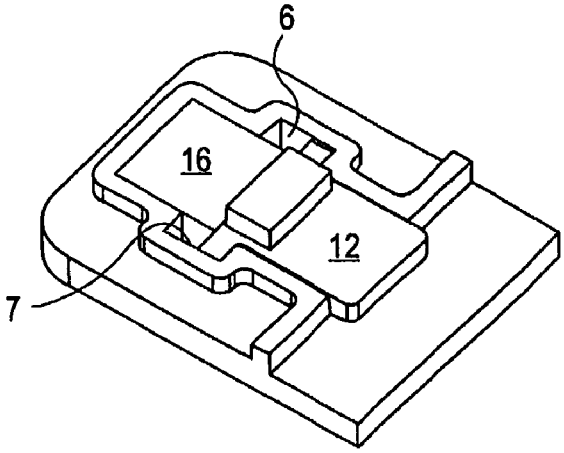
FIG. 1G illustrates a perspective view of a portion of a security device configured to be resettable.
Figure 1H:
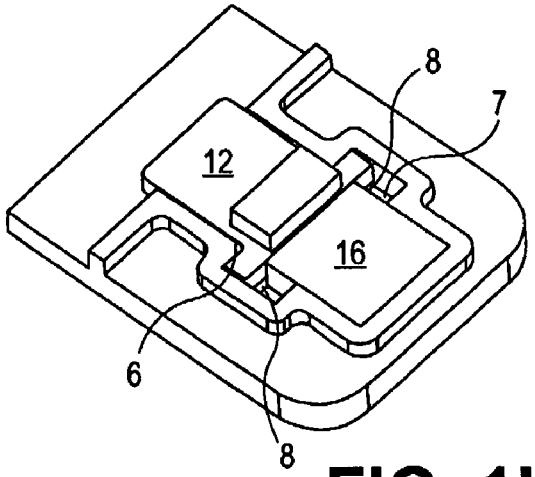
FIG. 1H illustrates a perspective view of a portion of a security device configured for one-time use.
Figure 1I:
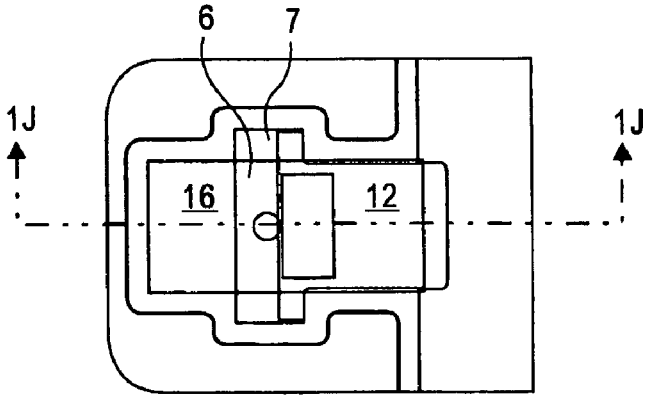
FIG. 1I illustrates a top view of a portion of a security device configured for one-time use.
Figure 1J:
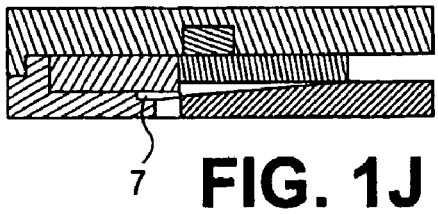
FIG. 1J illustrates a front view of a portion of a security device configured for one-time use.

In one embodiment, the security device 2 may be configured for one-time use. For example, in one embodiment as shown in FIGS. 1E-1F, the magnetically actuable latch 12 of the security device 2 may be positioned within a channel 3 as mated with the latch mating element 18 in the locking position. One or more leaf springs or other cantilevered arms, such as the cantilevered arms 4 and 5, are disposed in the channel 3 in a spring-loaded configuration.

For example, the cantilevered arm 4 may have an unloaded position as shown in FIG. 1E. The cantilevered arm may be bent to a position with its side 4A adjacent the channel wall 3A, and thus spring-loaded. The magnetically actuable latch 12 may then be disposed in the channel 3 in the locking position adjacent its other side 4B, preventing the cantilevered arm 4 from moving and preserving its spring load. The cantilevered arm 5 may be similarly positioned. Where the magnetically actuable latch 12 is then moved out of the locking position by the detacher 40, the cantilevered arms 4 and 5 may no longer be constrained by the magnetically actuable latch 12 and may spring back or otherwise return to their unloaded positions. Where in these positions the cantilevered arms 4 and 5 extend into the channel 3 such that they may block the base portion 13 of the magnetically actuable latch 12 from moving past them, the magnetically actuable latch 12 may not be able to return to the locking position. Thus, any appended security device may no longer be able to lock.

In another embodiment, only one of the cantilevered arms 4 and 5 is included. In various other embodiments, other resilient elements, such as coils or other springs, rubbers, and foams, for example, may be employed within the channel 3 or other portion of the housing to prevent the appended security device from being used twice.

In another embodiment such as shown in FIGS. 1G-1J, the locking mechanism portion and housing portion may be configured such that after each instance the magnetically actuable latch 12 is moved out of the locking position, the magnetically actuable latch 12 may need to be reset to enable it to be repositioned in the locking position. For example, the magnetically actuable latch 12 may be disposed in a channel 6 with its base end 13A adjacent a recess 7. The recess 7 may be configured such that where the magnetically actuable latch 12 is biased out of the locking position, at least a portion of the magnetically actuable latch 12 falls or is otherwise urged into the recess 7. The recess may be delineated by a wall 8 that may restrict movement of the magnetically actuable latch 12 back toward the locking position. In this embodiment, the security device in which the magnetically actuable latch 12 is disposed may be "reset" for use, such as by employing a magnet that may move the magnetically actuable latch 12 out of the recess.

FIGS. 2-9 illustrate various perspective views of a circular optical disc (OD) security device 102 (or a portion thereof) that may comprise a locking mechanism 110, security tag 120, and housing 130, in accordance with one embodiment. As used herein, the terms "circular optical disc" and "circular OD" refer to the following: any type of compact disc, including, for example, a Compact Disc (CD), Compact Disc Read Only Memory (CD-ROM), Mini CD-ROM, Compact Disc Recordable (CD-R), and Compact Disc Rewritable (CD-RW); any type of Digital Video Disc or Digital Versatile Disc (DVD), including, for example, a DVD, DVD Read Only Memory (DVD-ROM), DVD Recordable (DVD-R), High Definition DVD (HD-DVD); any other optical disc that may be at least partially cylindrical in shape with a central hole, or an optical disc that is flat and has a circular perimeter or is otherwise shaped like a CD or DVD or as any aforementioned CD or DVD type, including, for example, a Blu-ray disc (BD), BD Rewritable (BD-RE), BD Recordable (BD-R), and BD Read Only Memory (BD-ROM). In various other embodiments, the security device 102 (or a portion thereof), the locking mechanism 110, and the security tag 120 may be adapted to other articles such as non-circular optical discs, non-optical discs, and/or any other object formed in various geometric shapes and sizes.

Figure 2:
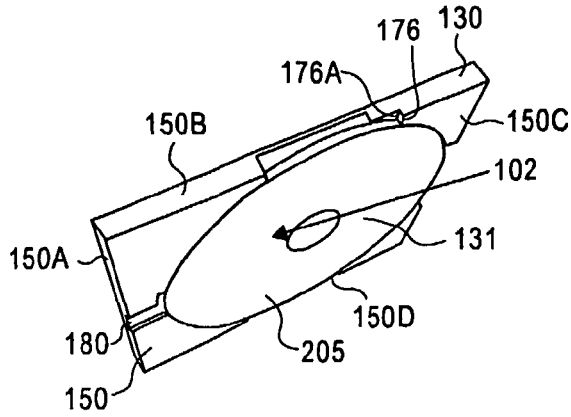
FIG. 2 illustrates a perspective view of a circular optical disc (OD) security device, in accordance with one embodiment.
Figure 3:
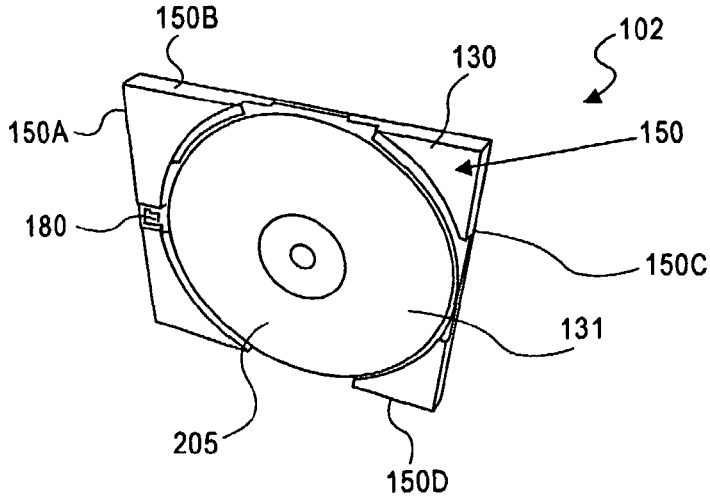
FIG. 3 illustrates a perspective view of a circular OD security device, in accordance with one embodiment.
Figure 4:
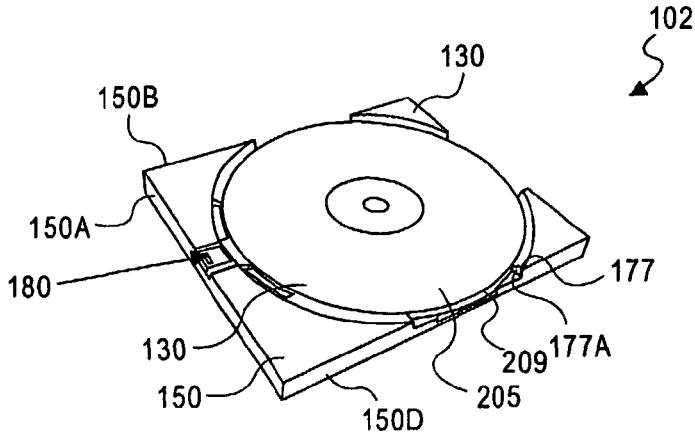
FIG. 4 illustrates a perspective view of a circular OD security device, in accordance with one embodiment.

The housing 130 shown in the embodiment of FIGS. 2-4 may have an outer shape at least partially like a cuboid, and may have an outer face 131 that is at least partially rectangular, and possibly also at least partially square, in shape. The housing 130, in various embodiments, may have an outer shape at least partially like any type of CD, DVD, BD, or other circular OD casing, or may have another shape. The housing 130 may be shaped and otherwise configured to partially or fully contain, enclose, affix to, or otherwise secure each of the locking mechanism 110, security tag 120, and an article that is a circular OD to the housing 130.

Figure 11A:
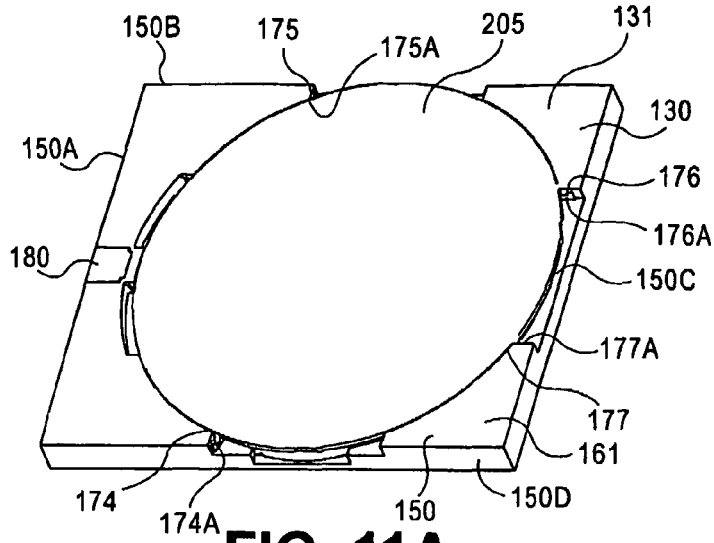
FIG. 11A illustrates a perspective view of a housing of a circular OD security device, in accordance with one embodiment.
Figure 11C:
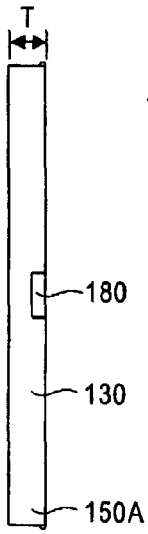
FIG. 11C illustrates a left side view of a housing of a circular OD security device, in accordance with one embodiment.
Figure 11B:
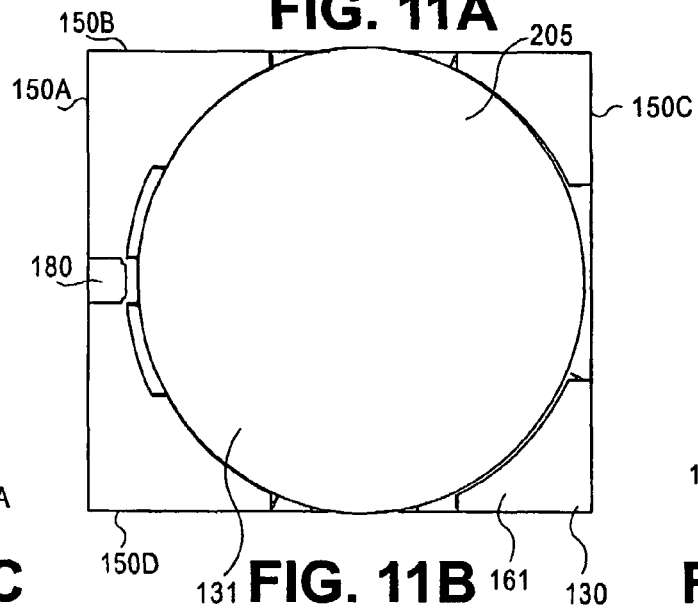
FIG. 11B illustrates a top view of a housing of a circular OD security device, in accordance with one embodiment.
Figure 11D:
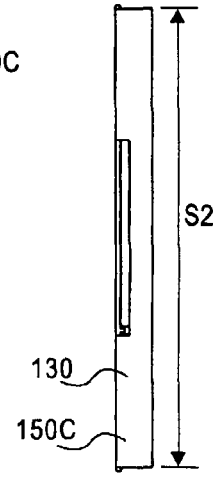
FIG. 11D illustrates a right side view of a housing of a circular OD security device, in accordance with one embodiment.
Figure 11E:
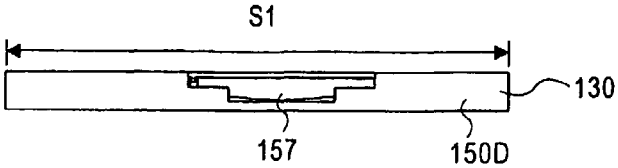
FIG. 11E illustrates a front view of a housing of a circular OD security device, in accordance with one embodiment.

For example, FIGS. 11A-11E illustrate a perspective, top, left side, right side, and front view, respectively, of one embodiment of a housing 130. The housing 130 may have a slender thickness T, As shown in FIGS. 11C-11E, as compared to the dimensions of the outer face 131, as shown in FIG. 11B. In one embodiment, the thickness T may be approximately 10.27 mm, and the face may have the approximate side dimensions S1 and S2 of 142.33 mm and 124.86 mm, respectively. The housing 130 in this embodiment may be shaped at least partially like a CD case or other circular OD case.

FIGS. 5-9 illustrate perspective views of embodiments of portions of the circular OD security device 102. FIGS. 10-13 illustrate other views of embodiments of the circular OD security device 102 and portions thereof.

Figure 6:
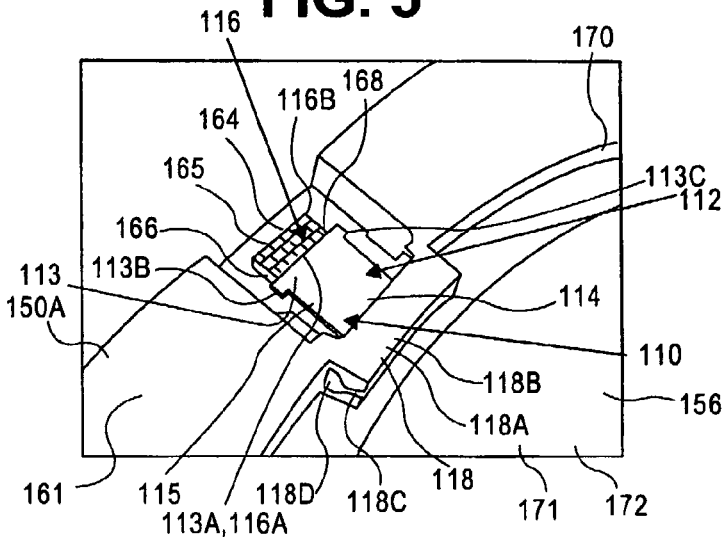
FIG. 6 illustrates a perspective view of a portion of a circular OD security device including a locking mechanism, in accordance with one embodiment.

Referring first to FIG. 6, this figure illustrates a perspective view of a portion of a circular OD security device 102 including a locking mechanism 110, in accordance with one embodiment. The locking mechanism 110 may include a magnetically actuable latch 112, a flexible element 116, and a latch mating element 118.

The magnetically actuable latch 112 may comprise a magnetic material, and may comprise one or more materials such as described with respect to the magnetically actuable latch 12 of FIG. 1. In addition, in one embodiment, the flexible element 116 may be combined or integrally formed with the magnetically actuable latch 112. In one embodiment, the flexible element 116 may be shaped as a cantilever arm, such as for example, a leaf spring. The magnetically actuable latch 12 may include a base portion 113, which may include a base portion end 113A and base portion side surfaces 113B and 113C; a latching portion 114, which may include a latching portion end 114A (positioned with the latch mating element 118 and therefore not shown in FIG. 6, but shown in FIG. 10); and a central portion 115.

The magnetically actuable latch 112 may be shaped like a "T". Thus, the base portion side surfaces 113B and 113C may be parallel and each may be at least substantially straight, and the width of the base portion 113, which may be the distance between base portion side surfaces 113B and 113C, may be wider than the other widths of the magnetically actuable latch 112. The base portion end 113A may be flat and may be substantially perpendicular to the base portion side surfaces 1113B and 113C. The magnetically actuable latch 112 may be configured with a slender thickness. However, the magnetically actuable latch 112 may be otherwise configured in various embodiments, such as described herein with respect to the magnetically actuable latch 12 shown in FIG. 1.

The flexible element 116 may comprise or be formed of a flexible material, and may include a material or materials such as described herein with respect to the flexible element 16 shown in FIG. 1. The flexible element 116, in one embodiment, may be configured with a substantially cuboidal shape such that its side 116A is wider than its side 116B. In various other embodiments, the flexible element 116 may be configured as, and comprise one or more materials of, a coil or other spring or like member, such as described above with respect to the magnetically actuable latch 12 of FIG. 1.

The latch mating element 118 may be integral with the housing 130 or a portion thereof as described below, or may be a separate piece or pieces.

Figure 7:
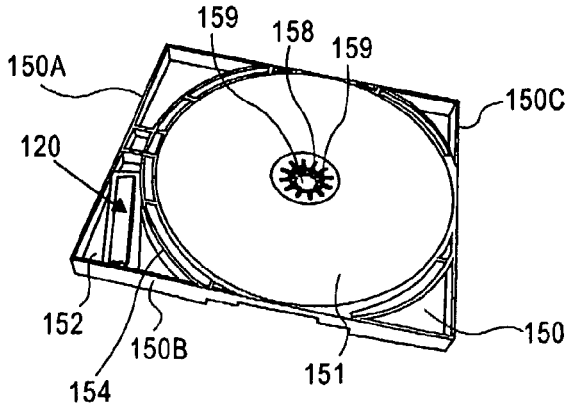
FIG. 7 illustrates a perspective view of a bottom housing and security tag of a circular OD security device, in accordance with one embodiment.
Figure 12A:
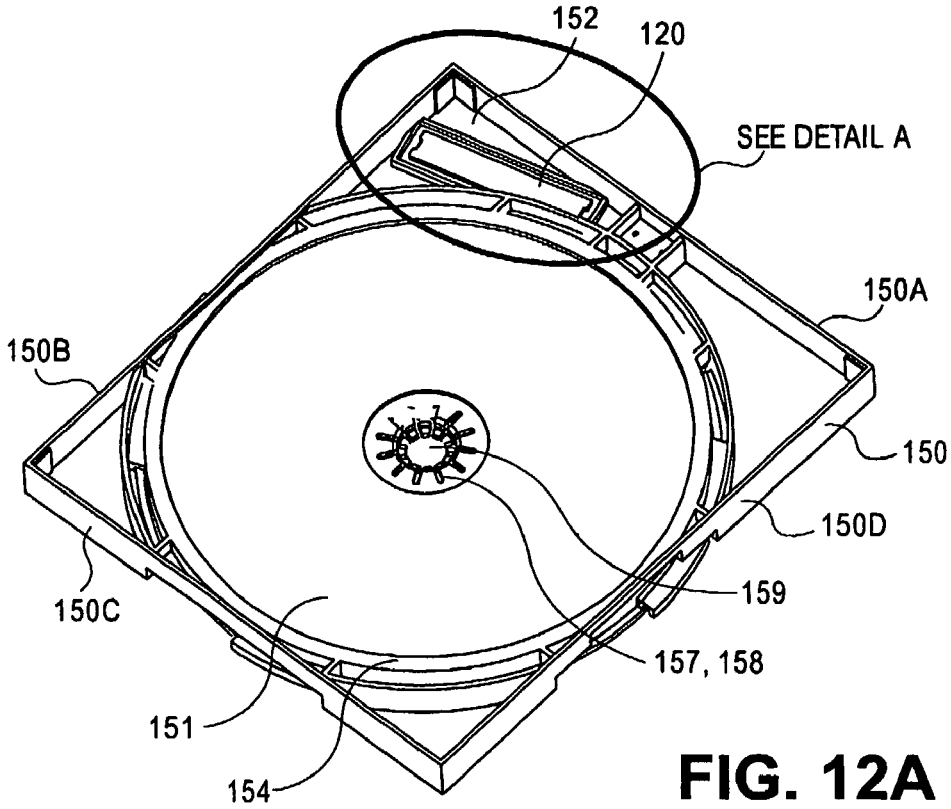
FIG. 12A illustrates a perspective view of a security tag and bottom housing of a circular OD security device, in accordance with one embodiment.
Figure 12B:
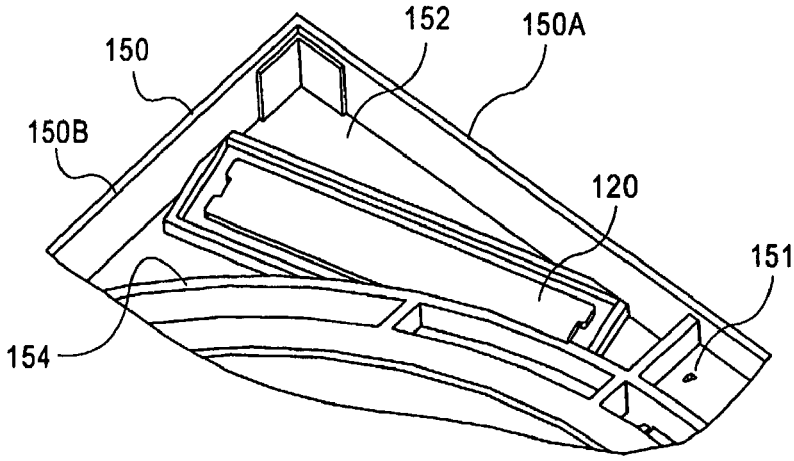
FIG. 12B illustrates an enlarged view of a portion A of FIG. 12A.

FIGS. 7 and 12A illustrate perspective views of a bottom housing 150, as described below, and a security tag 120 of a circular OD security device 102, in accordance with one embodiment. FIG. 12B illustrates an enlarged view of a portion A of the bottom housing 150 of FIG. 12A. Referring to FIGS. 7, 12A, and 12B, the security tag 120 may be an elongated EAS tag or label. In various other embodiments, the security tag 120 may be another type and/or shape of security tag or label, such as described herein with respect to the security tag 20 shown in FIG. 1. The security tag 120 may be affixed to the bottom housing 150, such as by epoxy, adhesive, or other means. In various other embodiments, the security tag 120 may be located on, disposed within, or secured to various other surfaces of the circular OD or other article.

The housing 130 of the circular OD security device 102, shown at least in part in each of the embodiments of FIGS. 2-13, may include the bottom housing 150, a locking mechanism cover 180, security tag cover 190, bottom cover 200, and top cover 205. In one embodiment, one or more of these components of the housing 130 may be separate components. In various other embodiments, one or more combinations of components may each comprise one piece or multiple pieces inseparably attached into one piece. Each of these components of the housing 130 may, in various embodiments, be made of plastic, another material, or a combination of materials. These components may, in various embodiments, comprise the same or different material or combination of materials.

Figure 5:
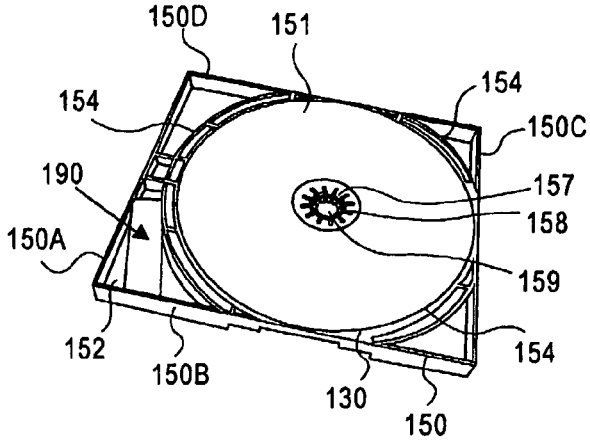
FIG. 5 illustrates a perspective view of a security tag cover and bottom housing of a circular OD security device, in accordance with one embodiment.
Figure 13A:
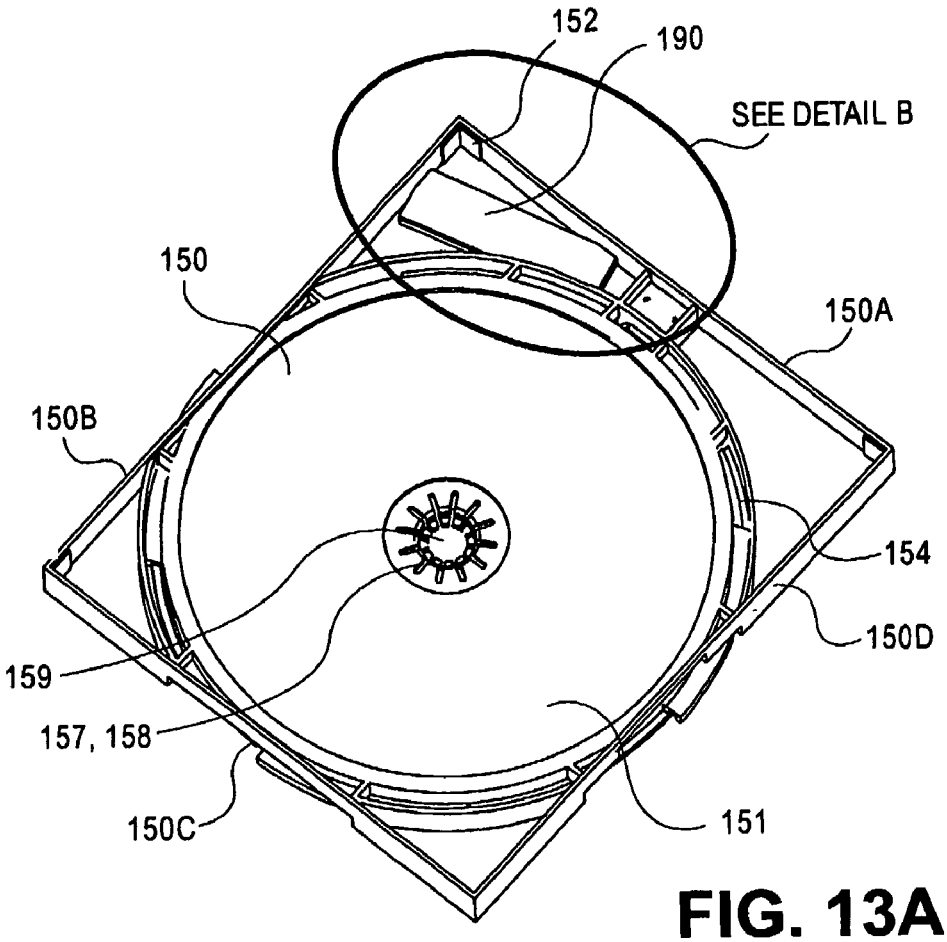
FIG. 13A illustrates a perspective view of a security tag cover and bottom housing of a circular OD security device, in accordance with one embodiment.
Figure 13B:
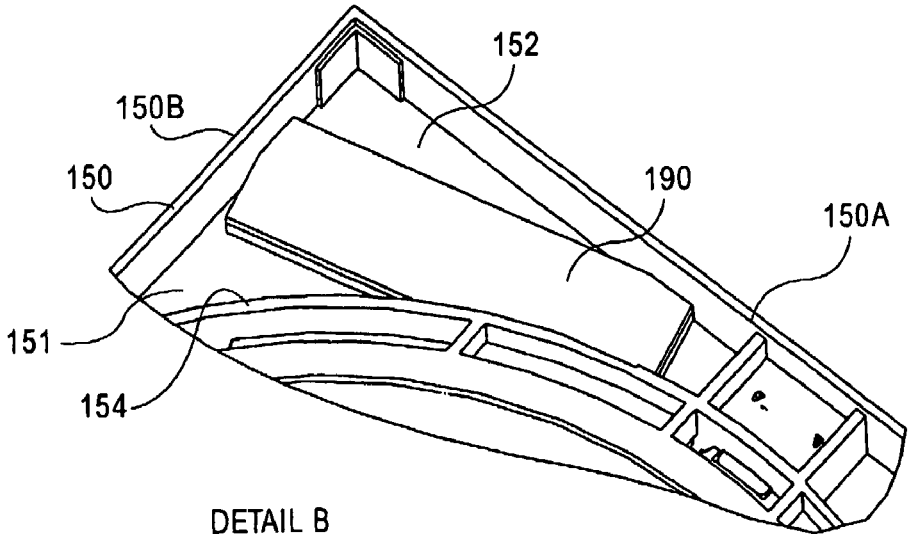
FIG. 13B illustrates an enlarged view of a portion B of FIG. 13A.

FIGS. 5 and 13A illustrate perspective views of a security tag cover 190, which is described below, and a bottom housing 150, in accordance with one embodiment. FIG. 13B illustrates an enlarged portion B of the bottom housing 150 of FIG. 13. Referring to the embodiments of FIGS. 5, and 13A-13B, the bottom housing 150 may have a rectangular outer shape delineated by bottom housing perimeter walls 150A through 150D. The bottom housing 150 may include a base 151 that includes a security tag receptacle 152, arcuate internal wall 154, and the base of a circular OD receptacle 156 comprising the base of a circular OD mating element 157 and a void 159. The security tag receptacle 152 may be delineated by the bottom housing perimeter walls 150A and 150D and the arcuate internal wall 154, and may be sized to receive an elongated security tag 120 and possibly also a security tag cover 190, such as described herein. In various embodiments, the housing perimeter walls 150A and 150C and/or 150B and 150D may be elongated to increase the area of the security tag receptacle 152, such that larger and/or differently sized security tags 120 may fit within the security tag receptacle 152.

The circular OD receptacle 156 may be integral with one or more of the bottom housing perimeter walls 150B through 150D and possibly the arcuate internal walls 154, or may be otherwise secured with the bottom housing 150.

Referring again to FIG. 6, this figure also illustrates a perspective view of an embodiment of part of the upper portion 161 of the bottom housing 150. The upper portion 161 may be configured such that the magnetically actuable latch 112 and flexible element 116 may be adjacently disposed therein. Thus, the base portion end 113A of the magnetically actuable latch 112 may be positioned near or in abutment with the flexible element 116. With such a configuration of the upper portion 161, the movement of the magnetically actuable latch 112 and flexible element 116 may be restricted in one or more directions.

For example, the upper portion 161 of the bottom housing 150 may include a channel end wall 165, channel walls 166 and 168, and a channel 164 that is delineated by the channel walls 166 and 168 and may be bounded by the channel end wall 165. The channel walls 166 and 168 may include portions substantially parallel to each other, and may be positioned close to or in contact with the magnetically actuable latch 112 at the base portion side surfaces 113B and 113C and at the sides of the central and latching portions 115 and 114, respectively, thereby restricting the movement of the magnetically actuable latch 112 to movement along the channel 164, which may be movement in a substantially linear direction. In various other embodiments, the magnetically actuable latch 112 may move in a rotational, combination rotational/linear direction, or any other direction or directions. In these various other embodiments, one or more of the channel 164, flexible element 116, and latch mating element 118 may be contoured, shaped, or otherwise configured to guide the magnetically actuable latch 112 in the direction or directions.

The flexible element 116 may be positioned adjacent the channel end wall 165 such that where the magnetically actuable latch 112 is forced away from the locking position and against the flexible element 116, the flexible element 116 may compress by the force of the magnetically actuable latch 112 and the resistant force of the channel end wall 165. The flexible element 116 may provide a resistant force to such compression, against such movement of the magnetically actuable latch 112.

As described above, in each of various embodiments the magnetically actuable latch 112 may be configured with another shape, in which case the channel 164, and thus the channel walls 166 and 168, may be configured to accommodate such a magnetically actuable latch 112 and possibly restrict the movement of the magnetically actuable latch 112 in one or more directions. In each of these embodiments, the flexible element 116 may be configured to fit within the channel 164.

Figure 10:
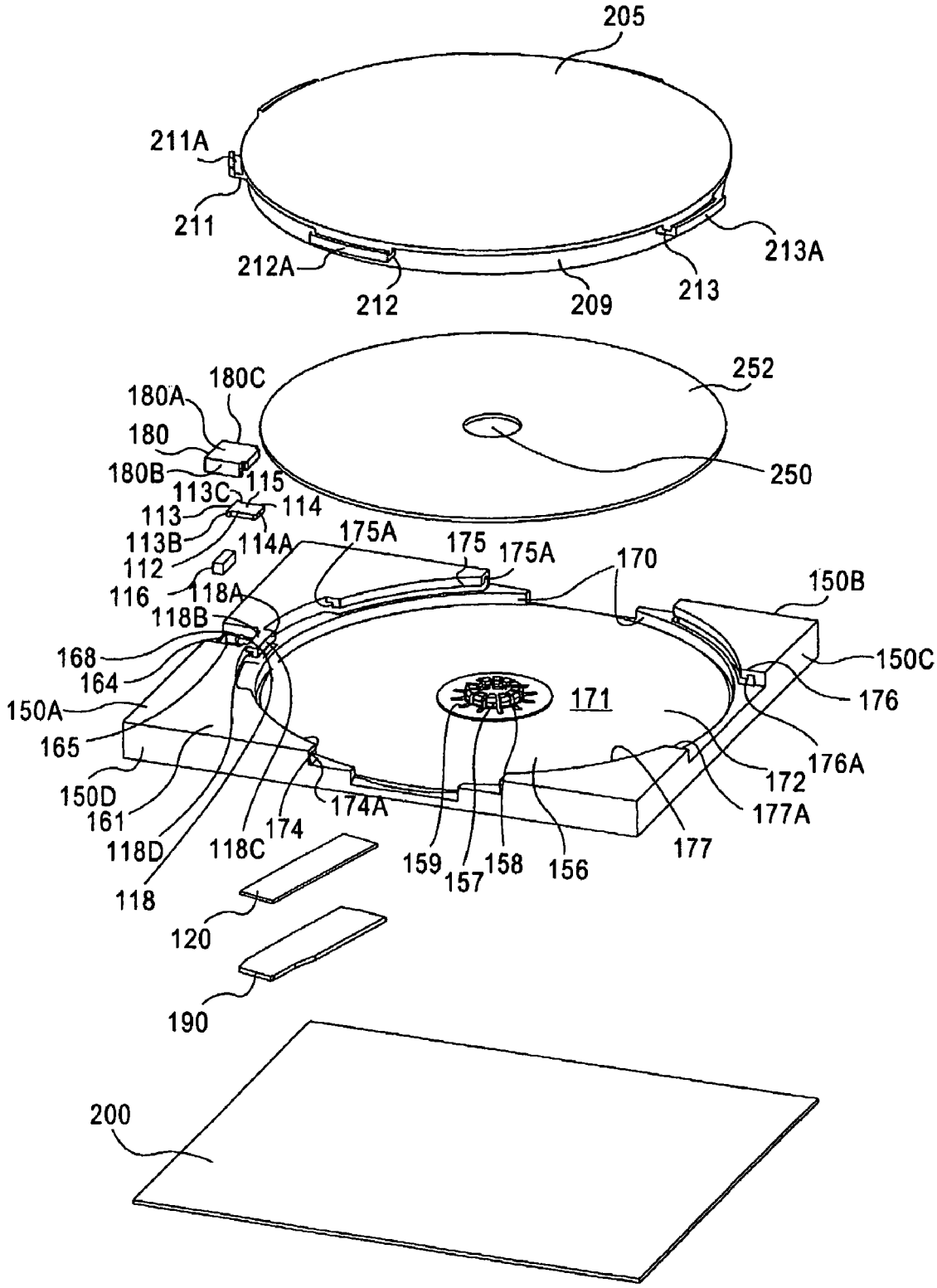
FIG. 10 illustrates an exploded view of a circular OD security device, in accordance with one embodiment.

FIG. 10 illustrates an exploded view of a circular OD security device 102, in accordance with one embodiment. Referring to FIG. 10 and again to FIG. 5, the upper portion 161 of the bottom housing 150 may include the upper portion of the circular OD receptacle 156. The upper portion of the circular OD receptacle 156 may comprise the OD mating element 157, a basin wall 170, a basin floor 171 defining a recessed surface of the OD receptacle, and a basin 172 delineated by the basin wall 170 and basin floor 171. The OD mating element 157 may include one or more cantilevered prongs 158 that may be integral with and define a void 159 of the bottom housing 150. The cantilevered prongs 158 may be positioned in a circular configuration as shown, and may be made of a material, such as a plastic, such that the cantilevered prongs 158 are resilient when bent inward, or toward the hole. The circular configuration may define an outer boundary having a radius that is the same or greater than that of the central hole of a circular OD, such as the central hole 250 of the circular OD 252. Thus, a circular OD may be disposed around, and secured by, the cantilevered prongs 158 and thus the OD mating element 157 by interference fit. When the circular OD is removed, the cantilevered prongs 158 may spring back to their unbent positions. In one embodiment, the circular configuration of the cantilevered prongs 158 may define an outer boundary having a radius that is less than that of the central hole of a circular OD.

In various other embodiments, the OD mating element 157 may comprise another structure, such as a solid, hollow, pronged, or other structure that may that mate with the central hole of a circular OD by interference fit, snap-fit, or other means. In another embodiment, the circular OD receptacle 156 does not include an OD mating element 157.

The basin wall 170 may be configured, such as circularly or otherwise configured, to delineate a basin 172 large enough such that a circular OD may fit within the basin 172 with or without contacting the basin wall 170.

The upper portion of the bottom housing 150 may also include groove walls 174-177 and arcuate grooves 174A-177A (177A is obscured and therefore cannot be seen in the FIG. 10) delineated by the groove walls 174-177, respectively. For example, the groove wall 174 may be included and may define an arcuate groove 174A. The interior of the groove wall 174, adjacent the arcuate groove 174A, may be shaped like a "J" or "U". Groove walls 175-177 may be included and comprise arcuate grooves 175A-177A. The arcuate grooves 174A-177A may be similarly shaped or substantially identical in shape. The groove walls 174-177 may each be positioned above or be integral with the basin wall 170, and may be spaced such that an OD may be moved past them to be disposed in, or removed from, the basin 172.

Referring again to FIG. 6 along with FIG. 10, the upper portion of the bottom housing 150 may also include the latch mating element 118. The latch mating element 118 may be integral with the bottom housing 150 and may extend between the channel walls 166 and 168 and may be cantilevered therefrom. The latch mating element 118 may comprise a latch mating element wall 118A having a hood 118B, end wall 118C, and a recess 118D defined by the latch mating element wall 118A. The latch mating element wall 118A may be configured such that the recess 118D is shaped like one or more of the arcuate grooves 174A-177A described above.

The latching portion 114 and possibly more of the magnetically actuable latch 112 may extend under the hood 118B and thus into the recess 118D when in the locking position. In one embodiment, the latching portion 114 and possibly more of the magnetically actuable latch 112 may extend across the recess 118D and to the end wall 118C.

The housing 130 may also include the locking mechanism cover 180 illustrated in the embodiment of FIGS. 2-4 and 10. The locking mechanism cover 180 may comprise a structure configured to be positioned over the flexible element 116 and at least a portion, such as an exposed portion, of the magnetically actuable latch 112. For example, as shown in FIG. 10, the locking mechanism cover 180 may include a hood 180A and sidewalls 180B and 180C that may cooperate with the channel 164 and/or channel walls 166 and 168 to enclose an exposed portion of the magnetically actuable latch 112 disposed in the channel 164. The locking mechanism cover 180 may be secured with the bottom housing 150, such as by welding, fusing, gluing, snap-fit (such as where the channel walls 166 and 168 and locking mechanism cover 180 are configured with mating protrusions and voids, for example), interference fit, and/or by other securing means. As secured, the locking mechanism cover 180 may prevent or increase the difficulty of removing the magnetically actuable latch 112 from the bottom housing 150.

Referring again to the embodiments of FIGS. 5 and 13A-13B, the housing 130 may also include a security tag cover 190. The security tag cover 190 may be configured to fit over the security tag 120, and may be secured within the security tag receptacle 152 and/or to the security tag 120, such as via fusing, welding, gluing, taping, mechanical fit, or by other means.

Figure 8:
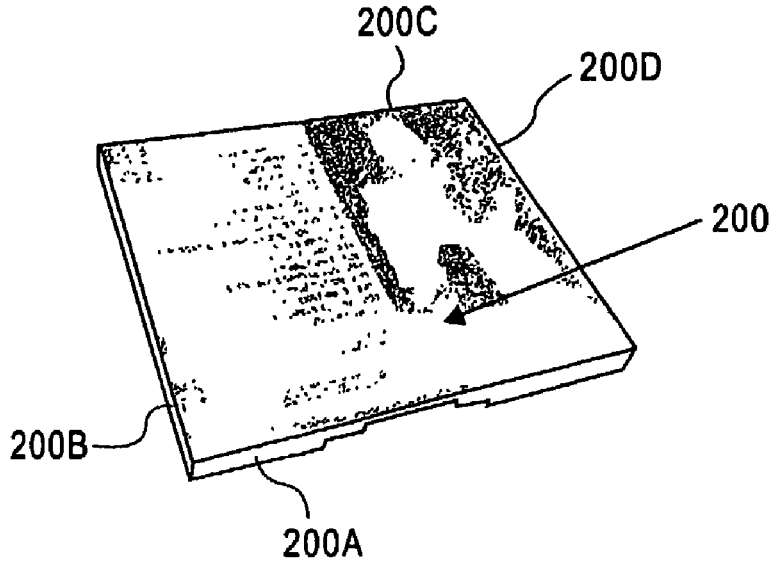
FIG. 8 illustrates a perspective view of a bottom cover of a circular OD security device, in accordance with one embodiment.

Referring to FIG. 8, this figure illustrates a perspective view of a bottom cover 200 of a circular OD security device 102, in accordance with one embodiment. The bottom cover 200 may be configured to be secured to the bottom housing 150. For example, the bottom cover 200 may have a rectangular shape delineated by bottom cover perimeter walls 200A through 200D and sized such that the bottom cover perimeter walls 200A and 200D may be secured around the bottom housing perimeter walls 150A through 150D of the bottom housing 150. Such securing may be by snap-fit, glue, tape, and/or by another means. In an embodiment where the bottom housing 150 is differently shaped, the bottom cover 200 may be configured with a complementary shape such that it may be secured to the bottom housing 150.

When the bottom cover 200 is secured to the bottom housing 150, the security tag 120 may be enclosed and thus secured therein so it may not be reached and removed.

Figure 9:
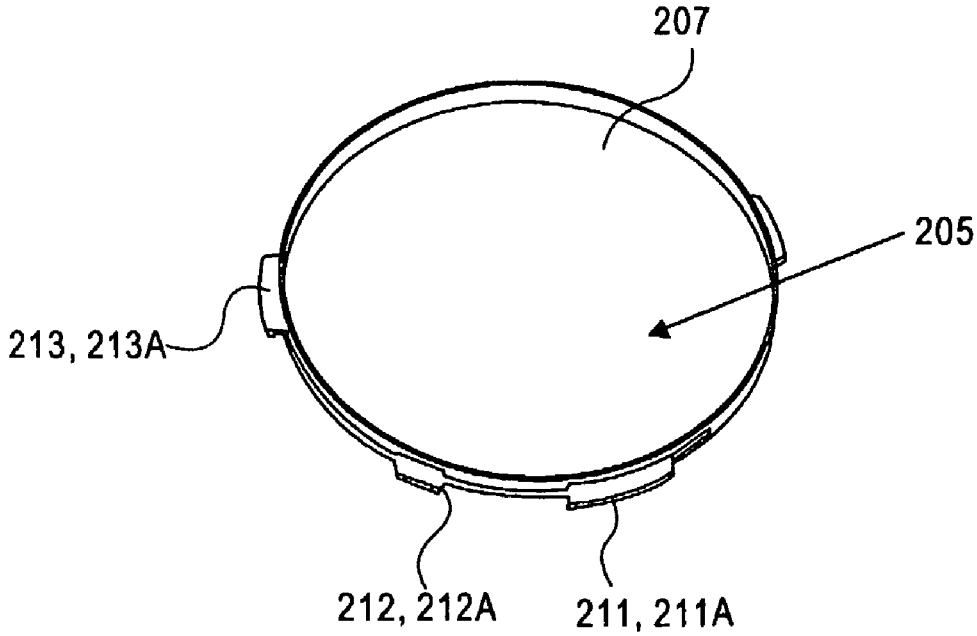
FIG. 9 illustrates a perspective view of a top cover of a circular OD security device, in accordance with one embodiment.

FIG. 9 illustrates a perspective view of a top cover 205 of a circular OD security device 102, in accordance with one embodiment. Referring to FIG. 9 along with the embodiments of FIGS. 2-4 and 10, the housing 130 may also include a top cover 205. The top cover 205 may be configured with a top cover base 207 that may be solid and may be bounded by a top cover wall 209. The top cover base 207 and top cover wall 209 may be circular and sized such that the inner radius of the top cover wall 209 is greater than the outer radius of a circular OD. In such a case, where a circular OD is disposed within the basin 172 of the bottom housing 150, as described above, the top cover base 207 and top cover wall 209 may fit over and around, respectively, the circular OD, thus enclosing the circular OD within the housing 130.

The top cover 205 may further include guide walls 211-213. The guide walls 211-213 may extend from the top cover wall 209 and may be shaped to cooperate with the groove walls 174-177 and latch mating element 118, including the latch mating element wall 118A. For example, in one embodiment, the guide walls 211-213 may extend from the top cover wall 209 in an "L" shape having arcuate lips 211A-213A, respectively, that are substantially parallel to the top cover wall 209. Thus, when the top cover 205 is fitted over and around a circular OD to enclose the circular OD within the housing 130, as described above, the arcuate lips 211A-213A of the guide walls 211-213, respectively, may slide within the arcuate grooves 174A-177A and recess 118D of the bottom housing 150 when the top cover 205 is rotated.

The top cover 205 may be positioned over a circular OD and onto the bottom housing 150 such that the latch mating element 118 is positioned between the guide walls 212 and 213. In this position, the arcuate lips 212A and 213A of the guide walls 212 and 213, respectively, may be positioned at least partly within the arcuate grooves 174A and 175A of the bottom housing 150. Since the magnetically actuable latch 112 may be biased by the flexible element 116 into the locking position within the recess 118D of the latch mating element 118, the magnetically actuable latch may block the arcuate lips 212A and 213A from being slid through recess 118D. Such a configuration may allow only limited rotation of the top cover 205 such that within this limited rotation, at least one of the arcuate lips 211A-213A may be positioned at least partly within an arcuate groove 174A-177A, thus securing the top cover 205 to the bottom housing 150. In another embodiment, the arcuate lips 211A-213A may be configured such that within that limited rotation, at least two of the arcuate lips 211A-213A are each positioned at least partly within an arcuate groove 174A-177A, further securing the top cover 205 to the bottom housing 150.

In various other embodiments, the mechanism for securing the top cover 205 to the bottom housing 150 may be modified, for example in one or more of the following ways: the bottom housing 150 may include variously sized and/or less than all of the groove walls 174-177 and thus the arcuate grooves 174A-177A, or may include additional groove walls and arcuate grooves; the top cover 205 may include variously sized and/or less than all three guide walls 211-213, and thus the arcuate lips 211A-213A; and/or the shapes of the groove walls, arcuate grooves, guide walls, and lips of the bottom housing 150 and top cover 205 may be modified. Thus, for example, the number and size of the groove walls, arcuate grooves, guide walls, and arcuate lips may be configured in the bottom housing 150 and top cover 205 such that the top cover 205 may be secured to the bottom housing 150 of the circular OD security device 102 when the magnetically actuable latch 112 is in the locking position, as described above.

In another embodiment, a circular OD security device system includes the circular OD security device 102 and a detacher, such as the detacher 40. Where the detacher 40 is placed near the magnetically actuable latch 112 of the circular OD security device 102 such that the flexible element 116 is positioned between the detacher 40 and magnetically actuable latch 112, the detacher 40 may magnetically force the magnetically actuable latch 112 out of the locking position and against the flexible element 116. If the magnetic force is greater than the compressive force of the flexible element 116 and any other forces resisting such movement of the magnetically actuable latch 112, the magnetically actuable latch 112 may move out of the locking position. In such case, the top cover 205 will no longer be blocked from full rotation, and the top cover 205 may be freely rotated. Thus, the top cover 205 may be rotated until no portion of any of its arcuate lips 211A-213A is positioned within an arcuate groove 174A-177A of the bottom housing 150, in which case the top cover 205 may be removed, exposing any circular OD that may be disposed within the basin 172 of the bottom housing 150. In other embodiments, the top cover 205 may be rotatably attached to the bottom housing 150 in a hinged or other suitable arrangement. In other embodiments, the top cover 205 may be otherwise securable or secured to the bottom housing 150, whether rotatably secured or attached. Because no part of the circular OD security device 102 in this embodiment may be broken during the process of unlocking it, the circular OD security device 102 may be reusable.

In one embodiment, the circular OD security device 102 may, or may be configured to, enclose or contain a CD, and may be called a CD security device 102. In this embodiment, the CD security device 102 may, or may be configured to, enclose or contain any other type of circular OD as well. In one embodiment, a security device, such as the CD security device 102, may be capable of holding an EAS tag, magnetic mechanism, and any type of CD. This security device may, in one embodiment, carry an EAS component and may be utilized to provide resistance to or prevent the unauthorized from taking and then leaving a store with the CD security device, and any type of CD that may be enclosed or otherwise secured thereto. In one embodiment, this security device may include a bottom housing, EAS label, EAS label cover, bottom cover, latch mechanism cover, magnetically actuable latch mechanism, and top cover. In one embodiment, the circular OD security device 102 may comprise this security device such that the locking mechanism 110 may include the magnetically actuable latch mechanism, the security tag 120 may include the EAS label or tag, and the housing 130 may include portions comprising the bottom housing, EAS label cover, bottom cover, latch mechanism cover, and top cover, which portions may correspond to the bottom housing 150, security tag cover 190, bottom cover 200, locking mechanism cover 180, and top cover 205, respectively.

While certain features of the embodiments have been illustrated as described herein, many modifications, substitutions, changes and equivalents will now occur to those skilled in the art. It is, therefore, to be understood that the appended claims are intended to cover all such modifications and changes as fall within the scope of the embodiments.

The invention claimed is:

1. A security device for an optical disc (OD), comprising:
- a security tag;
- a magnetically actuable locking mechanism having a first surface;
- a housing, the security tag and magnetically actuable locking mechanism secured to the housing, the housing comprising:
  - a bottom portion having;
    - at least one arcuate groove; and
    - an OD receptacle having:
      - an edge proximate to the magnetically actuable locking mechanism and;
    - a recessed surface; and
  - a top portion separable from the bottom portion, the top portion having at least one arcuate lip engageable with a corresponding at least one of the arcuate grooves; and
- the magnetically actuable locking mechanism magnetically moveable in a direction substantially perpendicular to the OD receptacle edge proximate to the magnetically actuable locking mechanism, the first surface of the magnetically actuable locking mechanism being substantially parallel to the recessed surface of the OD receptacle.

2. The security device of claim 1, wherein the magnetically actuable locking mechanism comprises a flexible element, a magnetically actuable latch, and a latch mating element.

3. The security device of claim 2, wherein the flexible element and the magnetically actuable latch are combined as a single piece.

4. The security device of claim 2, wherein the housing further comprises a channel, and wherein the magnetically actuable latch and flexible element are at least partially disposed in the channel.

5. The security device of claim 2, wherein the latch mating element is integral with the bottom portion.

6. The security device of claim 1, wherein the housing top portion is rotatably mateable with the housing bottom portion, wherein rotating the top portion engages an arcuate lip with a corresponding arcuate groove.

7. The security device of claim 2, wherein the latch mating element comprises a recess, and wherein the flexible element is positioned adjacent the magnetically actuable latch and biases the magnetically actuable latch toward a locking position in which at least part of the magnetically actuable latch extends into the recess.

8. The security device of claim 2, wherein the magnetically actuable latch is positioned between the flexible element and the latch mating element.

9. The security device of claim 2, wherein the magnetically actuable latch may be moved away from a locking position by magnetic force.

10. The security device of claim 9, wherein the magnetically actuable latch may be moved in a substantially linear direction.

11. The security device of claim 9, wherein the magnetically actuable latch may be moved in a substantially rotational direction.

12. The security device of claim 9, wherein the magnetically actuable latch may be moved in a combination of a rotational motion and a linear direction.

13. The security device of claim 1, wherein the OD is a compact disc.

14. The security device of claim 1, wherein the security device is reusable.

15. The security device of claim 1, wherein the security device is for one-time use.

16. The security device of claim 1, wherein the security device is resettable.

17. A security device for an optical disc (OD), comprising:
- a security tag;
- a magnetically actuable locking mechanism having a first surface;
- a bottom housing, the security tag and magnetically actuable locking mechanism disposed in the bottom housing, the bottom housing comprising:
  - at least one arcuate groove;
  - an edge proximate to the magnetically actuable locking mechanism; and
  - a recessed surface; and
- a top cover, the top cover lockable to the bottom housing, the top cover comprising at least one arcuate lip, at least a portion of one of the arcuate lips is positioned within at least a portion of at least one of the arcuate grooves when the security device is locked; and
- the magnetically actuable locking mechanism magnetically moveable in a direction substantially perpendicular to the edge proximate to the magnetically actuable locking mechanism, the first surface of the magnetically actuable locking mechanism being substantially parallel to the recessed surface of the bottom housing.

18. The security device of claim 17, wherein the bottom housing comprises an OD receptacle, wherein the OD receptacle is closed when the top cover is secured to the bottom housing.

19. The security device of claim 17, further comprising a security tag cover disposed over the security tag and on the bottom housing.

20. The security device of claim 17, further comprising a bottom cover secured to the bottom housing and around the security tag, thereby securing the security tag to the security device.

21. The security device of claim 17, wherein the bottom housing further comprises a channel, and wherein the magnetically actuable locking mechanism comprises a magnetically actuable latch and a flexible element that are adjacently positioned and each at least partially disposed within the channel.

22. The security device of claim 21, further comprising a locking mechanism cover secured over the channel and to the bottom housing, thereby securing the magnetically actuable latch and the flexible element to the security device.

23. The security device of claim 22, wherein the magnetically actuable locking mechanism further comprises a latch mating element, the latch mating element defining a recess.

24. The security device of claim 17, wherein the bottom housing further comprises a security tag receptacle, and wherein the security tag is disposed in the security tag receptacle.

25. A security system for an optical disc (OD), the security system comprising:

a security device comprising:

a magnetically actuable locking mechanism having a first surface; and a housing, the magnetically actuable locking mechanism secured to the housing, the housing comprising:

a bottom portion having;

at least one arcuate groove; and an OD receptacle having:

an edge proximate to the locking mechanism; and a recessed surface; and a top portion separable from the bottom portion, the top portion having at least one arcuate lip engageable with a corresponding at least one of the arcuate grooves;

a detacher to unlock the security device, the detacher comprising a magnet; and the magnetically actuable locking mechanism magnetically moveable in a direction substantially perpendicular to the OD receptacle edge proximate to the magnetically actuable locking mechanism, the first surface of the magnetically actuable locking mechanism being substantially parallel to the recessed surface of the OD receptacle.

26. A security device for an optical disc (OD), comprising:

a security tag;

a magnetically actuable locking mechanism having a first surface; and a housing comprising means for securing the security tag, locking mechanism, and OD thereto, the housing comprising a bottom means and a top means, the bottom means having:

at least one arcuate groove, an edge proximate to the table locking mechanism; and a recessed surface; and the top means being separable from the bottom means and having at least one arcuate lip engageable with a corresponding at least one of the arcuate grooves; and the magnetically actuable locking mechanism magnetically moveable in a direction substantially perpendicular to the edge proximate to the magnetically actuable locking mechanism, the first surface of the magnetically actuable locking mechanism being substantially parallel to the recessed surface of the bottom means.

* * * * *